United States Patent [19]

English

[11] 4,111,301

[45] Sep. 5, 1978

[54] ONE-PIECE CHAIR SHIPPING CONTAINER

[75] Inventor: Austin L. English, Conyers, Ga.

[73] Assignee: Weyerhaeuser Company, Tacoma, Wash.

[21] Appl. No.: 751,503

[22] Filed: Dec. 17, 1976

[51] Int. Cl.[2] ..... B65D 85/00

[52] U.S. Cl. ..... 206/326

[58] Field of Search ..... 206/326

[56] References Cited

U.S. PATENT DOCUMENTS

| | | | |
|---|---|---|---|
| 3,181,768 | 5/1965 | Flynn et al. | 206/326 |
| 3,934,720 | 1/1976 | Kratochvil, Jr. | 206/326 |
| 3,978,982 | 9/1976 | Dungan | 206/326 |

FOREIGN PATENT DOCUMENTS

| | | | |
|---|---|---|---|
| 227,603 | 3/1963 | Austria | 206/326 |

*Primary Examiner*—Herbert F. Ross

[57] ABSTRACT

A one-piece, rectangular corrugated paperboard blank is folded into an L-shaped container body having top, neck and shelf panels reinforced by underlying flaps extending from L-shaped side panels to which front and back panels are connected along corner fold lines. The flaps include triangular portions respectively folded under the shelf and neck panels.

8 Claims, 5 Drawing Figures

Fig. 1
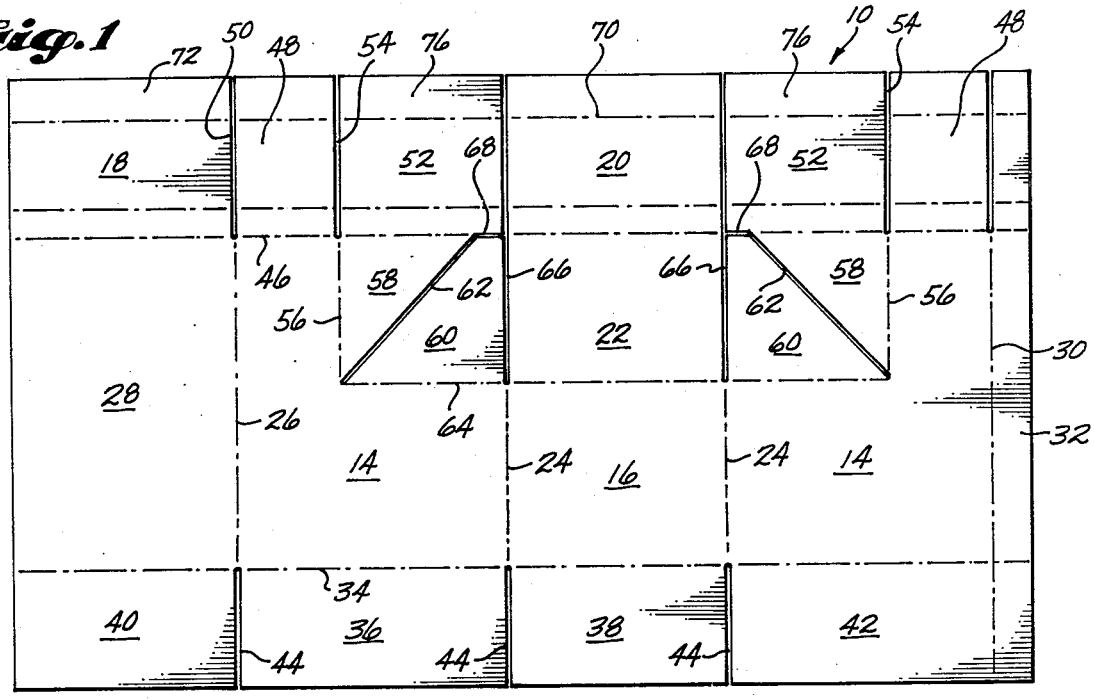
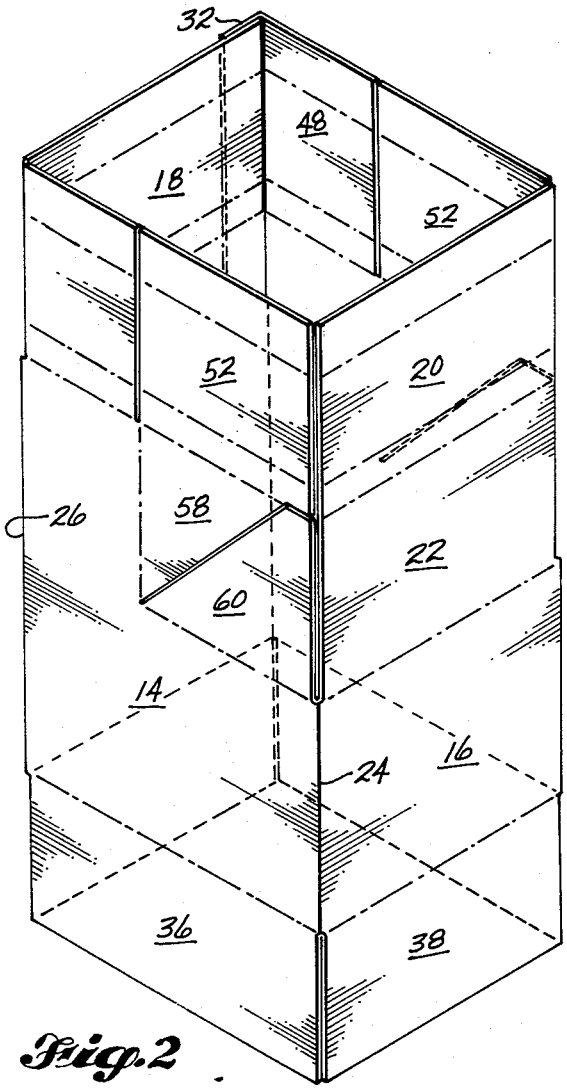
Fig. 2
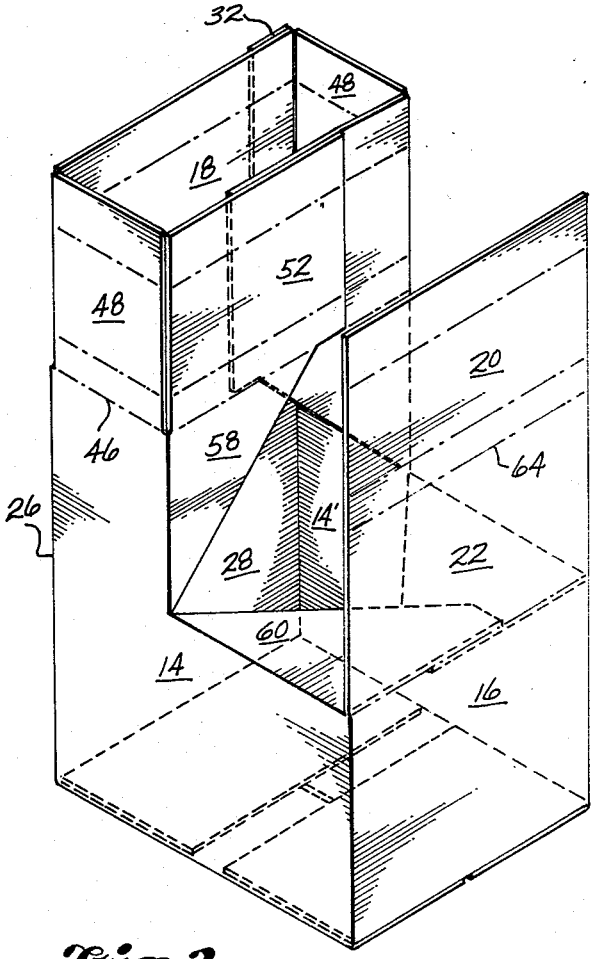
Fig. 3

ONE-PIECE CHAIR SHIPPING CONTAINER

BACKGROUND OF THE INVENTION

This invention relates to shipping containers made from folded, corrugated, paperboard blanks and more particularly to a one-piece container shaped to enclose irregular objects such as chairs.

Paperboard shipping containers having an L-shaped body are well known as disclosed, for example, in U.S. Pat. Nos. 1,131,948, 1,188,825, 2,068,095, 2,506,237, 2,891,710, 3,027,061 and 3,259,295. In the foregoing prior art, U.S. Pat. Nos. 2,891,710 and 3,027,061 also show shipping containers made from a one-piece paperboard blank. Further, the container shown in U.S. Pat. No. 2,891,710 to Repking is made from a rectangular blank generally similar to the shipping container of the present invention. However, the shipping container shown in the Repking patent requires cutting after it is assembled in order to form an L-shaped container body.

It is an important object of the present invention to provide an improved type of L-shaped shipping container made from a pre-cut paperboard blank that is easily erected by folding to provide a relatively rigid container for shipping of large objects such as chairs.

SUMMARY OF THE INVENTION

In accordance with the present invention, a rectangular, corrugated paperboard blank is pre-cut to form bottom flaps extending from back, side and front panels along a bottom fold line, said panels being interconnected along corner fold lines. The side panels are interconnected by the front panel and have triangular shaped flap elements extending therefrom along perpendicular fold lines. The triangular flap elements are folded into underlying relation to interconnected shelf and neck panels that extend from the front panel. The neck panel and a top panel extending from the back panel are both folded along a top fold line from which top closure flaps extend from the side panels.

BRIEF DESCRIPTION OF THE DRAWING FIGURES

FIG. 1 is a top plan view of a corrugated, paperboard blank from which a shipping container is made in accordance with the present invention.

FIGS. 2, 3 and 4 are perspective views showing the shipping container in different stages of erection and assembly.

DETAILED DESCRIPTION OF A PREFERRED EMBODIMENT

Figure 5:
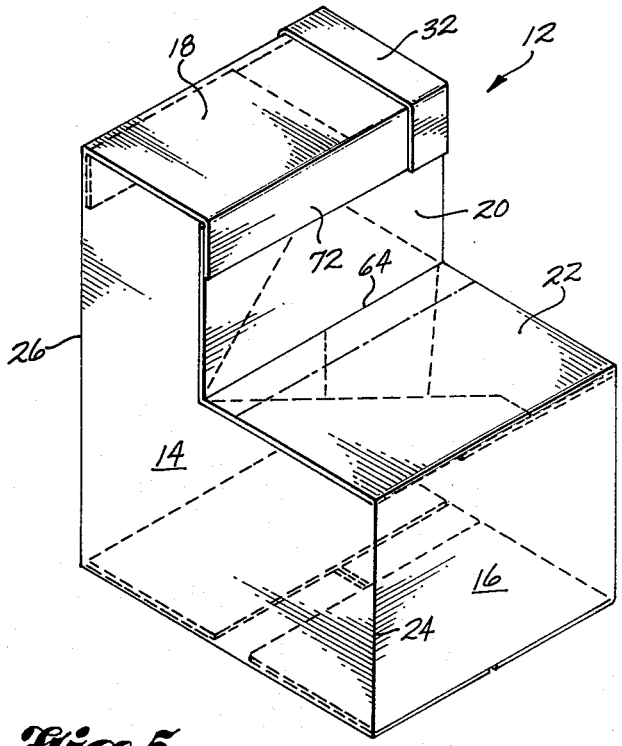
FIG. 5 is a perspective view showing the shipping container in a fully erected and assembled condition.

Referring now to the drawings in detail. FIG. 1 illustrates a corrugated, paperboard blank generally referred to by reference numeral 10 from which an L-shaped shipping container is erected as shown in FIG. 5, the shipping container being generally referred to by reference numeral 12. As more clearly seen in FIG. 5, the shipping container 12 is formed from an L-shaped body defined by planar panels including a pair of parallel spaced L-shaped side panels 14 and 14' interconnected by a rectangular front panel 16. The side panels are also bridged by rectangular top, neck and shelf panels, 18, 20 and 22.

As shown in FIG. 1, the side panels 14 and 14' are interconnected in mirror image relationship to each other by front panel 16 along corner fold lines 24. One of the side panels 14 is also interconnected along corner fold line 26 to a rectangular back panel 28 that is vertically longer than the front panel 16. The other side panel 14' has connected thereto along fold line 30 a back flap 32 adapted to be secured to the back panel 28 as will be referred to hereinafter. The corner fold lines 24, 26 and 30 are disposed in parallel spaced relationship to each other as shown in FIG. 1. The fold lines 24 and 26 terminate at a bottom fold line 34 from which bottom flaps 36, 38, 40 and 42 extend from the side, front and back panels. The bottom flaps are separated from each other by pre-cut slots 44 formed in the blank in alignment with the corner fold lines 24 and 26.

The blank 10 is also formed with a top fold line 46 parallel to the bottom fold line 34 and perpendicular to the corner fold lines 24 and 26. The top panel 18 extends from the back panel 28 along the top fold line 46 and is separated from top closure flap 48 by slot 50 that extends from the corner fold line 26. The top closure flap 48 associated with each side panel is separated from a second closure flap 52 by a slot 54 also extending from the top fold line 46 in alignment with a fold line 56. The fold lines 46 and 56 intersect to form a triangular flap element 58 that is separated from another generally triangular flap element 60 by a slot 62 forming the common hypotenuse of the triangular flap elements. The flap element 60 is connected to the side panel and foldable along a fold line 64 which intersects the fold line 56 at right angles and extends in parallel spaced relationship between the bottom and top fold lines. The fold line 64 defines the upper edge of the front panel 16 at which the shelf panel 22 is connected to the front panel. The neck panel 20, on the other hand, is connected to the shelf panel 22 along the top fold line 46. The shelf and neck panels are separated from the triangular flap element 60 and top closure flap 52 by slots 66 that extend in alignment with the corner folds 24. Short connecting slots 68 bridge the slots 62 with slots 66.

The blank 10 is also formed with an upper fold line 70 parallel to the top fold line 46 so as to define an assembly flap 72 associated with the top panel 18. Also, assembly flaps 74 and 76 are associated with the side panel closure flaps 48 and 52.

Figure 4:
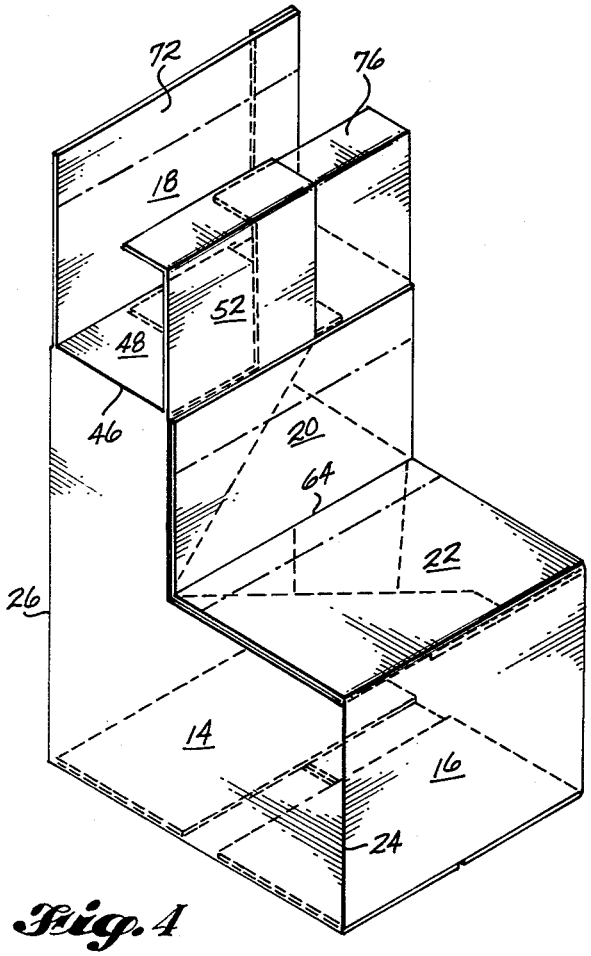

As shown in FIG. 2, the blank 10 is initially erected by folding along the corner folds 24 and 26 to form a rectangular tube. The back flap 32 is secured to the back panel 28 in order to hold the initially erected blank in its erected condition. The bottom flaps are folded inwardly and secured to each other in order to form a bottom support. The triangular flap elements 58 and 60 are then folded inwardly to the positions shown in FIG. 3. The flap elements 60 are shelf portions that form an underlying support or reinforcement for the shelf panel 22 that is folded thereover as shown in FIG. 4. The neck panel 20 as shown in FIG. 4 is also folded along the fold line 64 and overlies the triangular flap elements or neck portions 58. Since the closure flaps or top closure portions 52 extend from the triangular flap elements 58 at the fold line 46, they overlap each other as shown in FIGS. 3 and 4. The top closure flaps or top flap elements 48 are folded inwardly along the top fold line 46 between the overlapping closure flaps 52 and the top panel 18. The assembly flaps 76 associated with closure flaps 52 may then be folded around score line 70 as shown in FIG. 4 before the closure flaps 52 are folded downwardly over the closure flaps 48 and inserted against the upper portion of the back panel 28. The top panel 18 may then be folded over the underlying closure flaps 48 and 52 and the fully erected container completed by folding of the assembly flap 72 around score line 70 over the neck panel 20 to which it may be secured as shown in FIG. 5.

It will be apparent from the foregoing description that the triangular flap elements 58 and 60 associated with the side panels are readily folded into underlying relationship to the shelf and neck panels to not only provide reinforcement therefor but to accommodate pre-cutting of the blank.

It is to be understood that the embodiment herein described is illustrative, and it is also to be understood that the invention may be susceptible of embodiments in other modified forms and that all such modifications and their reasonable equivalents come within the scope of the claims next appearing.

What is claimed is:

1. A one-piece pre-cut shipping container comprising an L-shaped body formed by front, back, top, bottom, vertical neck, shelf and two L-shaped side panels, said side, back and front panels being interconnected along parallel spaced corner fold lines, bottom flaps connected to each side, back and front panels forming said bottom of the container, said top panel being connected to the back panel, said shelf and neck panels being perpendicular to each other and connected to the front panel, neck and shelf; neck and shelf flap means separately connected to the side panels in underlying relation to the top, neck and shelf panels to provide vertical strength to said neck panel and added strength to said shelf panel, said neck and shelf flap means being triangular and connected to the side panel along perpendicular fold lines respectively, and underlying rectangular top closure portions connected to respective neck flaps along a top fold line running adjacent the top edge of said neck panel.

2. The combination of claim 1 in which opposing triangular flap means overlap.

3. The combination of claim 1 wherein said flap means further includes a top flap element connected to the side panel along said top fold line and separated by a slot from the top closure portion.

4. The combination of claim 3 wherein said shelf, neck and top panels are separated from the flap means by parallel spaced slots.

5. The combination of claim 4 wherein the shelf panel is connected to the front panel along said one of the fold lines, said shelf panel being connected to the neck panel along said top fold line.

6. The combination of claim 1 wherein the shelf panel is connected to the front panel along said one of the fold lines, said shelf panel being connected to the neck panel along said top fold line.

7. The combination of claim 6 wherein said flap means further includes a top flap element connected to the side panel along said top fold line and separated by a slot from the top closure portion.

8. The combination of claim 1 wherein said shelf, neck and top panels are separated from the flap means by parallel spaced slots.

* * * * *